US008830649B2

(12) United States Patent
Oppermann et al.

(10) Patent No.: US 8,830,649 B2
(45) Date of Patent: Sep. 9, 2014

(54) FREE-WHEELING CIRCUIT

(75) Inventors: Christian Oppermann, Amberg (DE); Bernhard Streich, Amberg (DE)

(73) Assignee: Siemens Aktiengesellschaft, Munich (DE)

( * ) Notice: Subject to any disclaimer, the term of this patent is extended or adjusted under 35 U.S.C. 154(b) by 117 days.

(21) Appl. No.: 13/498,663

(22) PCT Filed: Aug. 10, 2010

(86) PCT No.: PCT/EP2010/061621

§ 371 (c)(1),
(2), (4) Date: Mar. 28, 2012

(87) PCT Pub. No.: WO2011/038969

PCT Pub. Date: Apr. 7, 2011

(65) Prior Publication Data

US 2012/0188675 A1 Jul. 26, 2012

(30) Foreign Application Priority Data

Sep. 29, 2009 (DE) ..... 10 2009 043 415

(51) Int. Cl.
*H01H 1/00* (2006.01)

(52) U.S. Cl.
USPC ..... 361/152

(58) Field of Classification Search
USPC ..... 361/152
See application file for complete search history.

(56) References Cited

U.S. PATENT DOCUMENTS 4,266,261 A 5/1981 Streit et al.
5,880,658 A 3/1999 Donhauser et al.
5,933,312 A * 8/1999 Schuhbauer et al. ..... 361/152
7,504,750 B2 * 3/2009 Bienvenu et al. ..... 307/138
2011/0310645 A1 * 12/2011 Godo ..... 363/56.12
2012/0206899 A1 * 8/2012 Takimoto et al. ..... 361/820

FOREIGN PATENT DOCUMENTS

CN 1036482 A 10/1989
CN 1184553 A 6/1998
CN 1185240 A 6/1998
CN 1515058 A 7/2004
DE 2828678 C2 9/1988

(Continued)

OTHER PUBLICATIONS

German Office Action for German Application No. DE 10 2009 043 415.1 (Not Yet Published).

(Continued)

*Primary Examiner* — Rexford Barnie
*Assistant Examiner* — Angela Brooks
(74) *Attorney, Agent, or Firm* — Harness, Dickey & Pierce, P.L.C.

(57) ABSTRACT

A free-wheeling circuit is disclosed for the rapid reduction of a shutdown overvoltage of an inductive load when the latter is shut down. The free-wheeling circuit includes a switching threshold component by which the free-wheeling circuit becomes active more rapidly compared to a free-wheeling circuit without said switching threshold component, thereby ensuring a more rapid reduction of the shutdown overvoltage. If a control voltage provided by a control voltage source falls below a threshold voltage set by the switching threshold component, a capacitive energy accumulator is immediately discharged and not only when the control voltage is reduced to near zero, and the energy accumulator then activates the free-wheeling circuit for reducing the shutdown overvoltage, when in the nearly discharged state.

8 Claims, 1 Drawing Sheet

(56) References Cited

FOREIGN PATENT DOCUMENTS

| | | | |
|---|---|---|---|
| DE | 29503146 | U1 | 4/1995 |
| DE | 19519757 | A1 | 12/1996 |
| DE | 19605973 | A1 | 8/1997 |
| DE | 10228340 | B3 | 2/2004 |
| JP | 59181004 | A | 10/1984 |
| JP | 2009-081901 | A | 4/2009 |

OTHER PUBLICATIONS

International Search Report.

Chinese Office Action dated May 16, 2014 for corresponding Chinese Application No. 201080043664.6.

* cited by examiner

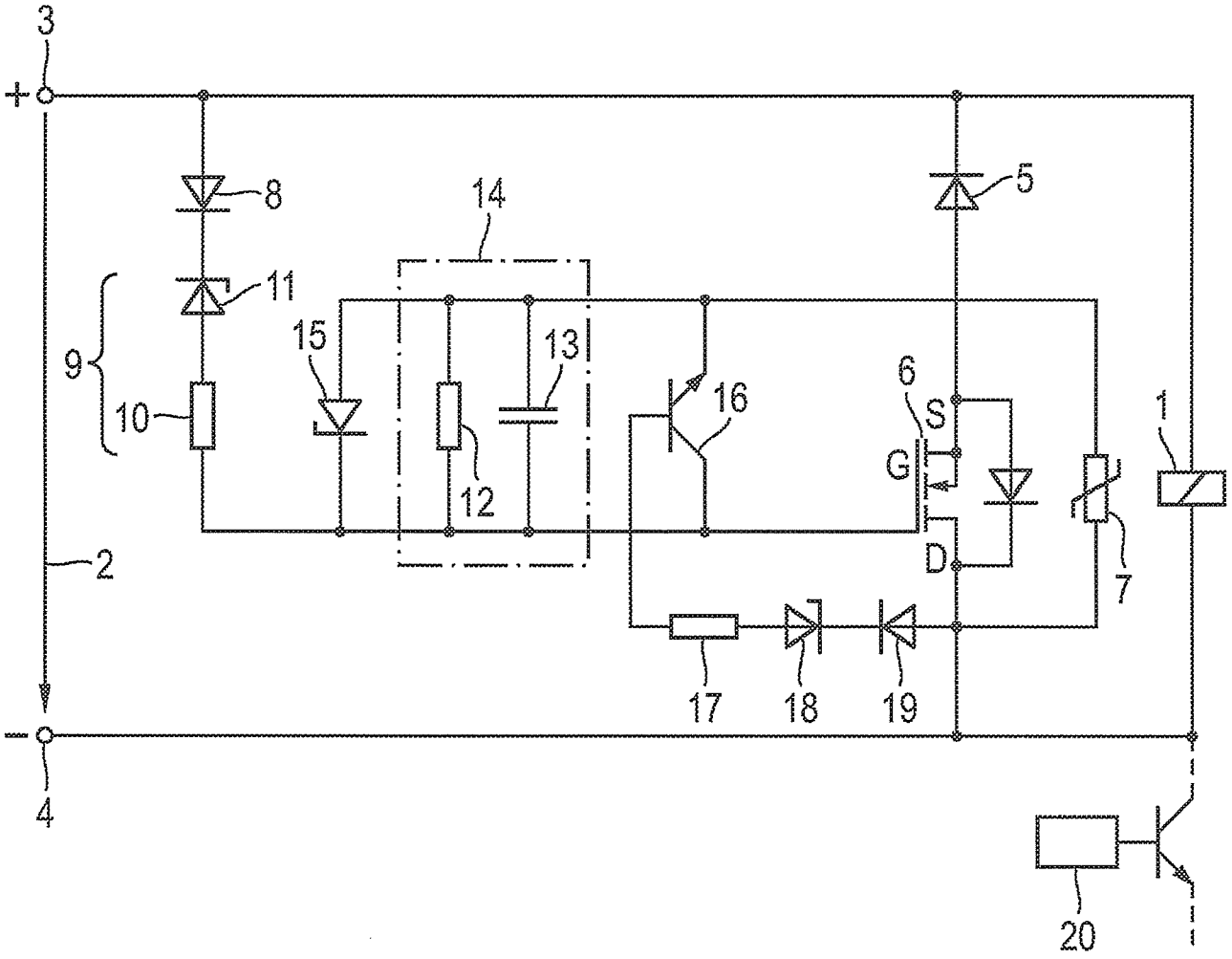
1
7
20
5
S
D
6
G
19
18
16
17
13
14
12
15
8
11
10
9
2
3
4
+
−

FREE-WHEELING CIRCUIT

PRIORITY STATEMENT

This application is the national phase under 35 U.S.C. §371 of PCT International Application No. PCT/EP2010/061621 which has an International filing date of Aug. 10, 2010, which designated the United States of America, and which claims priority to German patent application number DE 10 2009 043 415.1 filed Sep. 29, 2009, the entire contents of each of which are hereby incorporated herein by reference.

FIELD

At least one embodiment of the invention generally relates to a free-wheeling circuit.

BACKGROUND

Inductive loads, such as a coil of a line contactor switch for example, which are operated at a low-voltage switching device with DC control or control via a rectifier (AC/DC), only drop out very slowly after removal of a control supply voltage despite a free-wheeling circuit provided in the low-voltage switching device to reduce a shutdown overvoltage caused in such a case by the inductive load. In the worst case the result is what is referred to as a 2-step drop out, meaning for example that contacts switched in a main current path that are switched with the inductive load, are in contact with each other for a brief period without any spring force. The contacts can then easily become welded together or only have a short electrical service life overall.

Even if the inductive load is activated electronically, the free-wheeling circuit must be designed as a controlled or self-controlled circuit in order to ensure the fastest possible reduction of the magnetic energy stored in the inductive load when the inductive load is shut down.

It is generally known that this problem can be resolved by way of a diode or a Zener diode within the free-wheeling circuit.

The high power losses which occur permanently in such cases are a disadvantage with such solutions.

One variant in such solutions is to switch on and shut down the free-wheeling circuit in a controlled manner. In normal operation the free-wheeling circuit is shut down so that the power losses no longer occur permanently. To this end coil activation electronics evaluate switching thresholds and, depending on whether said thresholds are exceeded or not reached, the free-wheeling circuit is switched on or shut down, for example via an optocoupler.

Corresponding coil activation electronics are known from the document DE 195 19 757 C2 for example.

SUMMARY

The inventors have discovered that a disadvantage in this case is that if the control supply voltage provided for the inductive load is shut down or fails, said voltage must always be almost completely removed in each case before any capacitive energy accumulator present is made to discharge in each case, in order then, in the once again almost discharged state, to cause the free-wheeling circuit to be activated.

At least one embodiment of the present invention, starting from a coil activation electronics of the type mentioned at the start, improves the electronics technically in such a way that the free-wheeling circuit is activated more quickly if need be.

According to at least one embodiment of the invention, a free-wheeling circuit is disclosed.

In accordance with at least one embodiment of a free-wheeling circuit, an ohmic resistance component is realized in the control circuit of the free-wheeling circuit as a series circuit consisting of a pure ohmic resistor and a switching threshold component. In other words: An electronic component to create a switching threshold is introduced into the activation circuit of the free-wheeling circuit. The switching threshold in this case is able to be set by the choice or type of realization of the electronic component used.

BRIEF DESCRIPTION OF THE DRAWINGS

An example embodiment of the invention is explained in greater detail below with reference to a drawing with a single FIGURE.

The FIGURE shows a free-wheeling circuit connected in parallel to an inductive load 1, also abbreviated to coil below.

DETAILED DESCRIPTION OF THE EXAMPLE EMBODIMENTS

In accordance with at least one embodiment of a free-wheeling circuit, an ohmic resistance component is realized in the control circuit of the free-wheeling circuit as a series circuit consisting of a pure ohmic resistor and a switching threshold component. In other words: An electronic component to create a switching threshold is introduced into the activation circuit of the free-wheeling circuit. The switching threshold in this case is able to be set by the choice or type of realization of the electronic component used.

Further advantages of at least one embodiment may include: There is a short OFF delay; there is no two-step drop out; welding of contacts is prevented; the contacts thus have a long electrical service life; savings can be made in components and no electronic coil activation is necessary.

The result of using the switching threshold component is that the control supply voltage, if the control supply voltage is switched off or fails, does not first have to be completely removed until a capacitive energy accumulator is made to discharge, as a result of which discharging a relevant free-wheeling circuit is then switched to active. Depending on the switching threshold setting, the capacitive energy store is already made to discharge at an early residual value of the control supply voltage, namely when it falls below the set switching threshold value, with the consequence that the free-wheeling circuit is then switched to active correspondingly earlier. The free-wheeling circuit is thus activated more quickly and the shutdown overvoltage caused by the switching off or failure of the control supply voltage through the inductive load is then reduced more quickly.

Advantageous embodiments of the invention are the subject matter of subclaims.

Accordingly, in at least one embodiment, the switching threshold components can for example be realized by a simple Zener diode with a predetermined Zener voltage, by a thyristor with a Zener diode activation or a varistor circuit. All these realization options make it possible to adapt to the available situation by simple selection of the switching threshold.

At least one embodiment of the present free-wheeling circuit can also be equipped with better characteristics. If the capacitive energy accumulator has a second switching transistor connected in parallel to it which functions so that the second switching transistor becomes conductive on occurrence of a shutdown voltage through the inductive load, and through this a first switching transistor already present is safely blocked, the result is that the shutdown overvoltage caused by the inductive load is safely present at a voltage-dependent resistor and thereby the reduction of the shutdown overvoltage can be safely brought about.

The realization of the activation circuit of the second switching transistor in the manner that this activation circuit contains a series circuit of a third ohmic resistance, a second Zener diode and a third diode, with the second Zener diode and the third diode being connected with opposed polarities, guarantees the safe blocking of the first switching transistor by the second switching transistor.

The FIGURE shows a free-wheeling circuit connected in parallel to an inductive load 1, also abbreviated to coil below. This parallel circuit is connected to a control supply voltage source 2 with a plus pole 3 and a minus pole 4. The free-wheeling circuit comprises a series circuit line directly in parallel with the coil 1 including a first diode 5 and a first switching transistor 6 to which a voltage-dependent resistor 7 is switched in parallel. In this case the drain terminal D of the switching transistor 6 is connected to the minus pole 4. The source connection S of the switching transistor 6 is connected to the anode of the first diode 5, which in its turn is connected by its cathode connection to the plus pole. The plus pole 3 is connected via a second diode 8 and a resistance component 9 lying in parallel thereto to the gate terminal G of the first switching transistor 6.

The resistance component 9 is realized as a series circuit including the first ohmic resistor 10 and a switching threshold component 11.

A parallel circuit 14 including a second ohmic resistor 12 and a capacitor 13 lies between the source terminal S and the gate terminal G of the first switching transistor 6. A first Zener diode 15 and a second switching transistor 16 lie in parallel to the parallel circuit 14, which lies with its emitter at the source connection S and its collector at the gate connection G of the first switching transistor 6.

The base of the second switching transistor 16 is switched via a series circuit including the third ohmic resistor 17, a second Zener diode 18 and a third diode 19 to the minus pole 4, wherein the anode connection of the third diode 19 is present at this pole and the two cathode terminals of the third diode 19 and of the second Zener diode 18 are connected to each other.

The coil 1 is for example a protective coil which can be connected, as shown, in series to an electronic controller 20. As indicated in the FIGURE by dashed lines, the electronic controller 20 clocks the minus pole 4 if necessary.

The control supply voltage source 2 is a DC voltage source with which the coil 1 is supplied. At the same time, a control voltage is applied via the second diode 8 and the ohmic resistance component 9 to the parallel circuit of the first Zener diode 15, the second ohmic resistor 12 and the capacitor 13 lying in series.

Through the applied control voltage the first switching transistor 6 is switched to the conducting state, which is maintained for as long as the control supply voltage source 2 is connected. If the control supply voltage source 2 is switched off or fails the activation voltage of the first switching transistor 6 is only reduced slowly in accordance with the time constant predetermined by the parallel circuit 14 until it reaches a value at which the first switching transistor 6 blocks. To avoid the unstable switching state of the first switching transistor 6 in its linear operating range a secure blocking of the first switching transistor 6 operating as a free-wheeling transistor is guaranteed by the second switching transistor 16.

The diode circuitry of the second switching transistor 16, including the third ohmic resistor 17, the second Zener diode 18 and the third diode 19, is used, on occurrence of overvoltages at the first switching transistor 6 which arise when the first switching transistor 6 is operating in the linear range, to activate the second switching transistor 16 securely and thereby securely short circuit the gate-source path of the first switching transistor 6 and thus safely block said transistor.

The voltage-dependent resistor 7 serves to protect the drain-source path of the first switching transistor 6. It reduces the shutdown overvoltages arising at the coil 1 when the control supply voltage source 2 is switched off and protects the first switching transistor 6 from destruction.

Variants of the second ohmic resistor 12 and the capacitor 13 enable the residual energy stored in the coil 1 to be reduced more or less quickly or, when used for a protective coil, enable the shutdown delay time of the coil to be set as required. This applies only until the maximum shutdown delay time in which the contactor would drop out without the circuitry.

Through the dimensioning of the first diode 5, which is also referred to as a free-wheeling diode, the first switching transistor 6 and the voltage-dependent resistor 7, the circuitry can be adapted to different electromagnetic drives.

The free-wheeling circuit can also be used for an electronically clocked coil controller 20.

Compared to previously known circuit arrangements the free-wheeling circuit described here is constructed in a significantly simpler way and with fewer components.

Instead of the described first switching transistor 6 and second switching transistor 16, other switching transistor types can also be used.

The advantage of this free-wheeling circuit lies in its self-controlled effect. It is thus based, on occurrence of shutdown overvoltages at the coil 1, on the free-wheeling transistor, i.e. the first switching transistor 6, being safely blocked and thereby the current flow being commuted at the voltage-dependent resistor 7.

The switching threshold component 11 which is realized in the FIGURE by a Zener diode 11 polarized in the blocking direction with a predetermined voltage, has a switching threshold function for the parallel circuit 14. Provided the control voltage made available by the control voltage source 2 is greater than the Zener voltage of the Zener diode 11, the capacitive energy accumulator formed by the parallel circuit 14 is charged and the first switching transistor 6 is switched to the conducting state.

If the control voltage made available by the control voltage source 2 is switched off or if it collapses to at least below the Zener voltage of the Zener diode 11, the Zener diode 11 blocks as from the time at which the voltage falls below said voltage and through the capacitive energy accumulator formed by the parallel circuit 14 from this time on there is no longer charging, but there is discharging from this time. The capacitive energy accumulator is thus not discharged until the control voltage has dropped to almost zero, but only when the set switching threshold is undershot. Thus the first switching transistor 6 is switched more quickly into the blocking state and thus in turn the free-wheeling circuit is activated more quickly to reduce the shutdown overvoltage caused by the coil 1.

The Zener diode 11 forming the switching threshold component 11 can, connected and switched accordingly, also be realized in the form of a thyristor with a Zener diode activation or in the form of a varistor circuit.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A free-wheeling circuit for an inductive load for reducing shutdown overvoltages caused by the inductive load when the inductive load is shut down, the free-wheeling circuit comprising:

a series circuit including a first diode and a voltage-dependent resistor parallel to a coil;

a first switching transistor, connected in parallel to the voltage-dependent resistor;

a parallel circuit, including an ohmic resistor and a capacitor at its control input, to activate the first switching transistor; and a series circuit, including a second diode and an ohmic resistance component at a control supply voltage source, the ohmic resistance component being a series circuit including another ohmic resistor and a switching threshold component.

2. The free-wheeling circuit of claim 1, wherein the switching threshold component includes a Zener diode, a thyristor with a Zener diode activation or a varistor circuit.

3. The free-wheeling circuit of claim 1, wherein the parallel circuit is connected in parallel to a second switching transistor, and wherein, upon occurrence of a shutdown overvoltage at the inductive load, the second switching transistor conducts and the first switching transistor is blocked.

4. The free-wheeling circuit of claim 3, wherein the activation circuit of the second switching transistor includes a series circuit including a third ohmic resistor, a Zener diode and a third diode, wherein the Zener diode and the third diode are connected with opposing polarities.

5. The free-wheeling circuit of claim 2, wherein the parallel circuit is connected in parallel to a second switching transistor, and wherein, upon occurrence of a shutdown overvoltage at the inductive load, the second switching transistor conducts and the first switching transistor is blocked.

6. A free-wheeling circuit for an inductive load for reducing shutdown overvoltages caused by the inductive load when the inductive load is shut down, the free-wheeling circuit comprising:

a series circuit including a first diode and a voltage-dependent resistor parallel to a coil;

a first switching transistor, connected in parallel to the voltage-dependent resistor;

a parallel circuit, including an ohmic resistor and a capacitor at its control input, to activate the first switching transistor; and a series circuit, including a second diode and an ohmic resistance component at a control supply voltage source, the ohmic resistance component being a series circuit including another ohmic resistor and a switching threshold component, wherein, the parallel circuit is connected in parallel to a second switching transistor, upon occurrence of a shutdown overvoltage at the inductive load, the second switching transistor conducts and the first switching transistor is blocked, the switching threshold component includes a Zener diode, the activation circuit of the second switching transistor includes a series circuit including a third ohmic resistor, another Zener diode and a third diode, and the another Zener diode and the third diode are connected with opposing polarities.

7. A free-wheeling circuit for an inductive load for reducing shutdown overvoltages caused by the inductive load when the inductive load is shut down, the free-wheeling circuit comprising:

a series circuit including a first diode and a voltage-dependent resistor parallel to a coil;

a first switching transistor connected in parallel to the voltage-dependent resistor;

a parallel circuit, including an ohmic resistor and a capacitor at its control input, to activate the first switching transistor; and a series circuit, including a second diode and an ohmic resistance component at a control supply voltage source, the ohmic resistance component being a series circuit including another ohmic resistor and a switching threshold component, wherein, the parallel circuit is connected in parallel to a second switching transistor, upon occurrence of a shutdown overvoltage at the inductive load, the second switching transistor conducts and the first switching transistor is blocked, the switching threshold component includes a thyristor with a Zener diode activation or a varistor circuit, the activation circuit of the second switching transistor includes a series circuit including a third ohmic resistor, a Zener diode and a third diode, and the Zener diode and the third diode are connected with opposing polarities.

8. The free-wheeling circuit of claim 1, wherein the switching threshold component is connected between the second diode and the another ohmic resistor.

* * * * *